US009169584B2

(12) United States Patent
Khokar

(10) Patent No.: US 9,169,584 B2
(45) Date of Patent: Oct. 27, 2015

(54) METHOD AND MEANS FOR MEASURED CONTROL OF TAPE-LIKE WARPS FOR SHEDDING AND TAKING-UP OPERATIONS

(75) Inventor: Nandan Khokar, Gothenburg (SE)

(73) Assignee: TAPE WEAVING SWEDEN AB, Boras (SE)

( * ) Notice: Subject to any disclaimer, the term of this patent is extended or adjusted under 35 U.S.C. 154(b) by 60 days.

(21) Appl. No.: 13/879,658

(22) PCT Filed: Oct. 19, 2011

(86) PCT No.: PCT/EP2011/068223

§ 371 (c)(1),
(2), (4) Date: Sep. 23, 2013

(87) PCT Pub. No.: WO2012/052460

PCT Pub. Date: Apr. 26, 2012

(65) Prior Publication Data

US 2014/0000749 A1 Jan. 2, 2014

(30) Foreign Application Priority Data

Oct. 19, 2010 (EP) ..... 10187977

(51) Int. Cl.
*D03D 49/06* (2006.01)
*D03D 15/00* (2006.01)
(Continued)

(52) U.S. Cl.
CPC ..... *D03D 49/06* (2013.01); *D03D 15/0088* (2013.01); *D03D 41/008* (2013.01); *D03D 47/34* (2013.01); *D03D 49/14* (2013.01)

(58) Field of Classification Search
CPC . D03D 41/008; D03D 15/0088; D03D 15/00; D03D 13/002; D03D 41/00; D03D 15/0077; D03D 47/16; D03D 47/18; D03D 47/20; D03D 49/10; D03D 49/20; D03D 49/60; D03D 13/00; D03D 15/0011; D03D 15/008; D03D 41/004; D03D 47/00; D03D 47/34; D03D 49/06; D02G 3/06; D02G 3/40; D03C 13/00
USPC ..... 139/11, 383, DIG. 1, 100, 103, 188 R, 139/420 R, 426 R, 429, 438, 443, 1 R, 116.1, 139/420 A, 55.1
See application file for complete search history.

(56) References Cited

U.S. PATENT DOCUMENTS 3,918,501 A * 11/1975 Wolstencroft ..... 139/452
4,816,327 A * 3/1989 Binnersley et al. ..... 442/186
(Continued)

FOREIGN PATENT DOCUMENTS

CN 101120128 A 2/2008
EP 1838909 A1 * 10/2007 ..... D03D 3/08
(Continued)

OTHER PUBLICATIONS

Chinese Office Action mailed May 6, 2014 for China Patent Application No. 201180049865.1.
(Continued)

*Primary Examiner* — Bobby Muromoto, Jr.
(74) *Attorney, Agent, or Firm* — Harness, Dickey & Pierce, P.L.C.

(57) ABSTRACT

A method and means are disclosed for measured control of tape-like warps for shedding and taking-up operations when producing woven materials comprising tape-like warps and wefts. According to this invention, a displaceable contact surface of the warp control device is located between the warp supply source and the shedding device. The warp control device includes a displaceable member for providing contact surface to displace at least some of the tape-like warp for releasing them in a measured way for shed forming and taking-up operations. Further, the contact surfaces are retracted for enabling shed closing and measured taking-up.

15 Claims, 4 Drawing Sheets

(51) Int. Cl.

| | |
|---|---|
| ***D03D 41/00*** | (2006.01) |
| ***D03D 49/14*** | (2006.01) |
| ***D03D 47/34*** | (2006.01) |
| *D03D 15/02* | (2006.01) |

(56) References Cited

U.S. PATENT DOCUMENTS

| | | | | |
|---|---|---|---|---|
| 4,846,230 | A * | 7/1989 | Mock et al. | 139/383 R |
| 6,070,619 | A | 6/2000 | Tamura et al. | |
| 6,148,871 | A * | 11/2000 | Hassell et al. | 139/420 A |
| 6,186,185 | B1 * | 2/2001 | Khokar | 139/1 R |
| 6,338,367 | B1 * | 1/2002 | Khokar | 139/11 |
| 6,367,513 | B1 * | 4/2002 | Cain | 139/383 R |
| 6,431,222 | B1 * | 8/2002 | Khokar | 139/383 R |
| 6,450,208 | B1 * | 9/2002 | Khokar | 139/11 |
| 6,539,983 | B2 * | 4/2003 | Khokar | 139/383 A |
| 6,889,720 | B2 * | 5/2005 | Khokar | 139/11 |
| 7,259,113 | B2 * | 8/2007 | Dufresne-Nappert et al. | 442/2 |
| 7,992,596 | B2 * | 8/2011 | Khokar | 139/420 R |
| 8,129,294 | B2 * | 3/2012 | Khokar | 442/186 |
| 2002/0124900 | A1 * | 9/2002 | Khokar | 139/11 |
| 2003/0116218 | A1 * | 6/2003 | Khokar | 139/11 |
| 2005/0121828 | A1 * | 6/2005 | Kobue et al. | 264/259 |
| 2007/0210490 | A1 * | 9/2007 | Malloy et al. | 264/425 |
| 2008/0257443 | A1 * | 10/2008 | Khokar | 139/443 |
| 2009/0007981 | A1 * | 1/2009 | Khokar | 139/383 A |
| 2011/0041677 | A1 * | 2/2011 | De Weijer et al. | 89/36.02 |
| 2011/0097526 | A1 * | 4/2011 | Goering | 428/36.1 |
| 2014/0000749 | A1 * | 1/2014 | Khokar | 139/103 |
| 2014/0004296 | A1 * | 1/2014 | Khokar | 428/104 |
| 2014/0083553 | A1 * | 3/2014 | Khokar | 139/11 |

FOREIGN PATENT DOCUMENTS

| | | | | |
|---|---|---|---|---|
| JP | 7 278997 | A | 10/1995 | |
| WO | WO-02/066721 | A1 | 8/2002 | |
| WO | WO-2006/075961 | A1 | 7/2006 | |
| WO | WO-2006/075962 | A1 | 7/2006 | |
| WO | WO 2006075961 | A1 * | 7/2006 | D03D 3/08 |
| WO | WO 2006075962 | A1 * | 7/2006 | D03D 3/08 |

OTHER PUBLICATIONS

International Search Report and Written Opinion for PCT/EP2011/068223, mailed Mar. 14, 2013; ISA/EP.

* cited by examiner

METHOD AND MEANS FOR MEASURED CONTROL OF TAPE-LIKE WARPS FOR SHEDDING AND TAKING-UP OPERATIONS

CROSS-REFERENCE TO RELATED APPLICATIONS

This application is a 371 U.S. National Stage of International Application No. PCT/EP2011/068223, filed on Oct. 19, 2011, which claims priority to European Patent Application No. 10187977.3, filed Oct. 19, 2010, the contents of which are hereby incorporated by reference in their entirety as if fully set forth herein.

FIELD OF THE INVENTION

The present invention concerns the weaving process in general. In particular, it concerns a method and means for controlling tape-like warps for shedding and taking-up operations when producing woven materials comprising tape-like warps and wefts.

BACKGROUND OF THE INVENTION

Weaving with tape-like warps and wefts is of relatively recent origin. The obtaining state of the art in the field is represented by U.S. Pat. No. 6,450,208 and WO2006/075961. The specification disclosed in WO02/066721 is a conventional method of weaving in the field. The document WO2006/075961, by the same applicant, discloses a method for feeding tape-like warps in specified lengths for the shedding and fabric taking-up operations. In this method the tape-like warps are clamped and the required length drawn out from its supply spools by a suitable working arrangement described therein. This system is functionally accurate in feeding the required lengths of most types of tape-like warps but presents some drawbacks, in particular when processing certain materials.

A first drawback concerns the system's inability to draw out the warp tapes in equal lengths due to slippage in its clamping action. For example, this is a problem when tapes of very thin, flimsy and low-friction materials are to be processed. The warp tape slippage problem gets amplified especially when the diameter of the warp supply spools (or their weights) are unequal, which practically is the normal case as it is impossible to have all warp spools of either equal diameter or weight, particularly more so when the tapes are of either flimsy or delicate or special types. Furthermore, if tapes of thin, flimsy and low-friction materials are to be processed together with tapes of different materials that exhibit somewhat different physical features in relative comparison, the tape slippage problem gets even more serious and difficulties in achieving satisfactory weaving are encountered.

Of course such a feeding system could be improved by making the clamping action stronger and through use of suitable constructional materials. However, by doing so another problem crops up. The tape-like warps get indented and sometimes even deformed and damaged with broken fibers. Consequently, the quality of the resulting tape-woven material suffers.

A further drawback with the said system arises from the use of certain special tapes, e.g. tacky pre-preg tapes. Its clamping components tend to collect the tacky material from such tapes when they are used as warps in the weaving process. As a result, the tacky tape-like warps adhere to the clamps causing frequent process stops for cleaning them up resulting in associated production loss in addition to adversely affecting the quality of the woven material.

The arrangement disclosed in WO02/066721 follows a conventional approach wherein warps are drawn from a single beam source and this warp is controlled by a combination of seven rollers (pressure rollers, guide roller, floating roller and compensating rollers), all of which work in conjunction with each other before warp reaches the shedding device, to regulate warp length changes during shed opening and shed closing. This arrangement is disadvantageous at least for the following reasons: (a) The actions of all these seven rollers unduly increase the frictional forces in the warp tapes and cause tension variations in them as (i) the warp tapes have to be necessarily constantly pressed or clamped by pressure rollers, (ii) the warp tapes have to be necessarily bent around two guide and one floating rollers, (iii) the warp tapes have to be necessarily intermittently pressed by pressure rollers; (b) When processing certain tapes, such as pre-preg, stiff and brittle types of tapes, their getting pressed and bent by these rollers will also cause undesirable fiber breakage; and (c) when processing tacky type of tapes, they will tend to adhere/stick at many points making weaving nearly impossible. Obviously the arrangement according to WO02/066721 is limited in its usefulness.

SUMMARY OF THE INVENTION

It is therefore an objective of the present invention to provide an apparatus and a method which at least partly overcomes the above-discussed problems. It is a further objective of the present invention to overcome the problems of tape slippage, fibre breakage, deformation by indentation, and sticking/adhering of tapes to apparatus surfaces by providing a novel method and means for providing required lengths of tape-like warps for shedding and taking-up operations.

This objective is achieved with an apparatus and a method according to the appended claims.

According to a first aspect of the invention there is provided an apparatus for producing a woven material from tape-like warps and wefts comprising:

a warp supply source for tape-like warps;

a shed forming device to form a shed by said warps;

a weft insertion device for inserting tape-like weft in the shed formed by said warps; and a take-up device for taking-up the produced woven material;

characterized in that the apparatus further comprises a warp controlling device located in the warp path from the warp supply to the shedding device, said warp controlling device comprising at least one displaceable contact surface, and an arrangement to displace the contact surface for displacing at least one of the warps between the warp supply and the shed forming device, whereby the displacement of said warp(s) releases them from the warp supply source for shed opening and taking-up, and to retract the contact surface for enabling shed closing and fabric taking up.

By the terms "located in the warp path" is in this context meant any form of interaction with the warp path, such as being in contact with the warps on one or a few locations, or over an extended part of the warps.

The novel means for controlling tape-like warps according to this invention solves the indicated problems through use of a warp controlling device comprising one or several displaceable contact surfaces, for example arranged on a reciprocating rolling member, located in the warp path defined by the positions of the warp supply spools and the shed forming device. Preferably, the contact surface(s) remains in contact with the tape-like warps at all times. This contact surface, e.g. arranged on a rolling member, of the controlling device is hereby oscillated between specified positions according to processing needs to control the lengths of tape-like warps required for shedding and taking-up operations. Hereby, a measured and highly controllable warp release from the warp supply and fabric taking up is enabled.

Further, the contact surface of the controlling device can also be directly made to additionally function as warp guide roller within the weaving set-up and thereby serve two purposes simultaneously. The present invention also effectively reduces the number of working components, both within the system as also the weaving set-up, relative to the available systems, and thereby simplify the construction and lower the cost of the weaving equipment. This new warp controlling system is also suitable for processing both tacky and non-tacky types of tape-like warps. Other advantages of the novel warp controlling system are a reduction in the associated down times during the process of weaving with tacky tape-like warps and improvements in the quality of woven materials comprising tacky tape-like warps.

The controlling device of the present invention also enables controlling of the tape-like warps for shedding and taking-up operations without any clamping of the warps. Accordingly, it provides a very gentle procedure and simplifies the apparatus.

The warp controlling device preferably comprises at least one contact surface arranged to preferably continuously remain in contact with the warps. The contact surface preferably comprises a low-friction surface, e.g. being provided by a low-friction coating. Alternatively, the contact surface may comprise a high-friction surface for a specific processing need.

The contact surfaces may be fixed in relation to the general direction of the warps, thereby allowing the warp to glide over the contact surfaces. However, preferably the contact surfaces are moveable along with the warps. In a preferred embodiment, the contact surface is arranged on a roller. By roller, in the context of this application, is meant any surface rotatable around one or several axes. For example, the roller may be of cylindrical or barrel form, rotatable around a single axis. However, it could also have any other suitable cross-sectional shape. In an alternative construction, two or more axes may be used, e.g. in the form of a broad belt or multiple narrow belts.

In a preferred embodiment, the warp controlling device comprises at least two independently operable contact surface displacement units. In such an embodiment, the weaving device preferably comprises a first warp controlling unit providing a first contact surface, and a second warp controlling unit providing a second contact surface, the first displacement unit being in contact with a first set of warps and the second displacement unit being in contact with a second set of warps. Each of the warps of the first and second sets of warps occurs adjacently arranged in relation to each other in the fabric. It is also feasible to provide a warp controlling device comprising independently operable displacement unit for each of the warps. Accordingly, each warp becomes independently controllable.

The contact surface of the warp controlling device is preferably displaceable between a base position and at least one displaced position.

The contact surface of the roller constituting the warp controlling device is arranged in or along at least one longitudinal direction of the warp controlling device, said longitudinal direction(s) essentially being parallel to a rotation axis of at least one of a shedding rotor, a take-up roller and a warp spool. When the contact surface is arranged on two or more rollers, this means that the rotation axes of the rollers are essentially parallel to the rotation axis of at least one of a shedding rotor, a take-up roller and a warp spool.

The warp controlling device preferably comprises a plurality of contact surfaces arranged along a line to be individually in contact with each of the warps, the contact surfaces being essentially parallel to a rotation axis of at least one of a shedding rotor, a take-up roller and a warp spool.

The device for inserting the tape-like weft preferably includes a gripper for gripping the weft tape in an essentially flat condition by means of clamping, and pulling it through the shed.

According to another aspect of the invention, there is provided a method for producing a woven material from tape-like warps and wefts comprising the steps:

providing tape-like warps from warp supply sources;

forming a shed by said warps;

inserting tape-like weft in the shed; and taking-up the produced woven material;

characterized in that the method further comprises the steps of:

displacing at least one contact surface which is in contact with at least some of the tape-like warps for displacing at least some of the warps, to release warp lengths from said warp supply sources for shed formation and taking up; and retracting said displaced contact surface for enabling shed closing and taking-up. According to this aspect, similar advantages as discussed above are obtainable.

Preferably, at least some of the warps are displaced independently of each other. Most preferably, a first set of warps is displaced independently of a second set of warps. In any case, the warps of both sets occur adjacently arranged in relation to each other in the fabric. It is also feasible to have each warp being displaced independently.

The method further preferably comprises the additional step of displacing, after shed formation but prior to take-up, at least some of the warps for release of warp from the warp supply for measured take-up.

Further, the step of inserting the tape-like weft preferably involves gripping a weft tape in an essentially flat condition by means of clamping, and pulling it through the shed.

These and other aspects of the invention will be apparent from and elucidated with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein.

DESCRIPTION OF PREFERRED EMBODIMENTS

Figure 1:
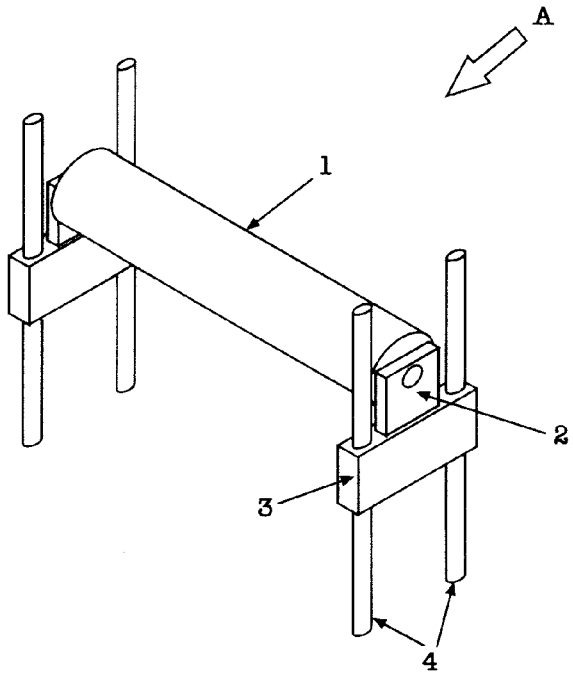
FIG. 1 exemplifies the general arrangement of the components of a warp controlling device in accordance with an embodiment of the present invention. The device is useable for collective displacement of measured lengths of tape-like warps for shedding and taking-up operations.

In the following detailed description, preferred embodiments of the present invention will be described. However, it is to be understood that features of the different embodiments are exchangeable between the embodiments and may be combined in different ways, unless anything else is specifically indicated. It may also be noted that, for the sake of clarity, the dimensions of certain components illustrated in the drawings may differ from the corresponding dimensions in real-life implementations of the invention.

The preferred embodiments of the warp controlling device for displacing tape-like warps for shedding and taking-up operations according to the present invention are described now in reference to FIGS. 1-6.

FIG. 1 shows the tape-like warp controlling device A which essentially comprises a rolling member 1 that can be turned about its axis. Member 1, which provides a contact surface to engage one or several of the warp(s), can be reciprocated in vertical or horizontal or angular direction depending on its relative orientation in machine for causing measured displacement of the warp tapes as shall be described in the following. Member 1 is supported at its ends by a suitable pair of connectors 2 that is fixed to the pair of blocks 3. Alternatively, the rolling member 1 could be directly supported in blocks 3. The blocks 3, each of which is located at either ends of the rolling member 1, are supported on a pair of columns 4 at either ends in a sliding manner. To prevent the rolling member 1 from moving in its axial direction during the weaving process, the columns 4 are suitably fixed to the machine framework (not shown). Each of the blocks 3 can be reciprocated mechanically in a sliding manner on their respective columns 4 through suitable driving arrangements such as rack-pinion or toothed belt-timing wheel or band-drum or chain-sprocket or pneumatic cylinders or eccentric drive etc. and thereby also cause the rolling member 1, the hence the contact surface, to be reciprocated in the desired controlled way. The distance of reciprocation can be set in available conventional ways.

It is preferable that the rolling member 1 has smooth surface and preferably covered with either a coating or a sheet of a suitable non-adhering and low friction material such as PTFE (commercially called Teflon), or the like, to prevent sticking of tacky tape-like warps to it. Depending on the nature of the warps to be processed, the surface of member 1 could be made high-friction as well. The rolling member 1 could be preferably either cylindrical or composed of multiple 'barrel' shaped projections to provide a 'crown' for preventing lateral displacement of the tape in contact with it. Further, the rolling member 1 could be incorporated in such a way that it can be either turned about its axis when desired or locked to prevent it from turning. The turning of member 1 could be performed either continuously or intermittently or in required degrees. Furthermore, the turning of member 1 could be performed in either clockwise or anti-clockwise directions. Depending on the employed constructional design and relative positions of the other working members of the weaving machine, the contact surface provided by rolling member 1 preferably remains in contact with the tape-like warps, maintaining at least a line or tangential contact, whether it is located above or under the tape-like warps, although in FIG. 2 member 1 is shown to be located under the tape-like warps Wa and Wb for representation. It is considered advantageous to have the contact surface of member 1 electrically grounded to prevent static charge build-up particularly when processing certain thermoplastic materials.

Certain important aspects of the tape-like warp controlling unit A need to be pointed out here in reference FIG. 2. To keep the weaving machine compact, simple and relatively low in cost, the controlling unit A can be designed in a way (i) to control the tape-like warps in either suitable groups or individually, and (ii) that it is easily accessible for attention in the weaving machine during production. Accordingly, it is preferable to have the tape-like warp spools 11 arranged in at least two groups 11*a* and 11*b* as shown in FIG. 2. It is to be remembered that the warp tapes always get divided into top and bottom sheets of the shed during shedding operation no matter what weave pattern is to be produced. When producing plain weave, the tape-like warps can be grouped into two rows so that each group is controlled collectively by its own units A1 and A2 as shown in FIG. 2.

As could be inferred from referring to FIG. 3, the controlling units could be also constructed and arranged in the weaving machine to individually control tape-like warps for producing any weave pattern, including plain. The individual units shown in FIG. 3 could be also arranged in a suitable zigzag arrangement, as shown in FIG. 4, to control a single planar sheet of tape-like warps. Needless to say, these individual warp controlling units could be also arranged in two or more rows.

Clearly, as can be understood from the foregoing description, the entire set of warp tapes is uniquely displaceable by the displaceable contact surfaces.

Figure 2B:
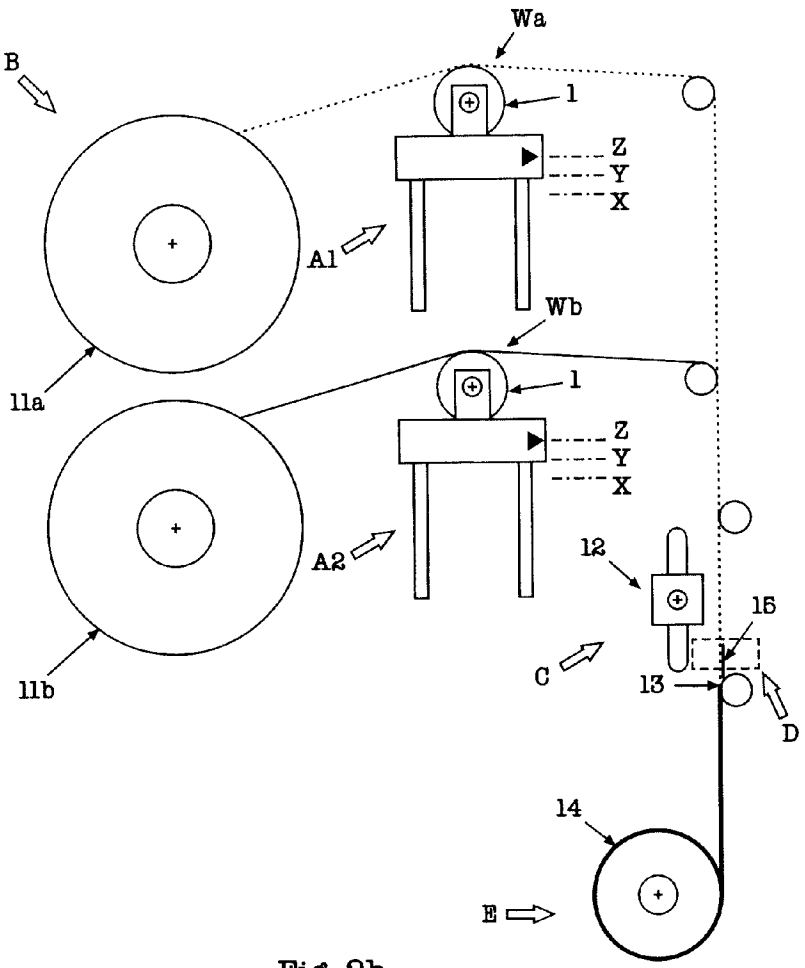
FIG. 2 exemplifies a schematic of a weaving apparatus comprising the controlling device, in accordance with embodiments of the present invention, for displacing measured lengths of tape-like warps for shedding and taking-up operations.

To obtain a woven material with uniform tension in tape-like warps, it is important that the axes of the rolling members 1 of units A1 and A2 are maintained parallel to the axes of the other members of the weaving device namely rotor 12 of the shedding device C and fabric take-up roller 14 of the taking-up device E shown in FIG. 2, as well as the shaft/s (not shown in FIG. 2) that support the warp spools 11*a* and 11*b* either from interior (from the central core) or exterior (from the spool edges) of the warp supplying device B. In the described embodiment of the invention it is clearly essential that contact surface of rolling member 1 is suitably positioned in the warp path defined by the positions of the warp supply spools 11 and the fabric-fell 13 and it preferably remains in contact with the tape-like warps. For enabling the weaving process to progress normally the insertion of weft 15, indicated in FIG. 2*b*, is achieved by a suitable device D.

Figure 2A:
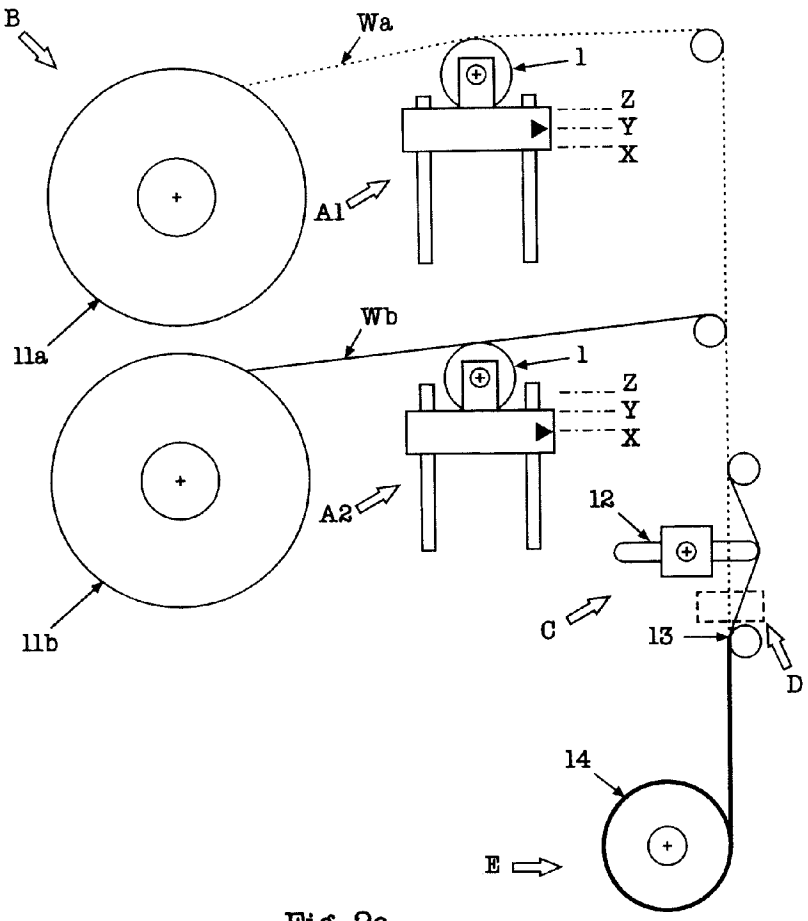

The working of the displacing unit A, in reference to production of plain weave, is shown in FIG. 2. Accordingly, the constituent warp tapes of the fabric are divided into two sets 11*a* and 11*b*. Warp tapes from the spools 11*a* and 11*b* follow the defined warp paths, together with suitably positioned guide rolls/bars in accordance with the designed layout of the weaving machine, to enable measured shedding, taking-up and fabric winding operations. The displaceable contact surface of rolling member 1 is ideally located in the warp path from the warp spools 11*a* and 11*b* to the shedding rotor 12 and they can be positioned either under or above the tape-like warps as mentioned earlier, although they are shown in FIGS. 2*a* and 2*b* to be under tape-like warps. The warp spools 11 can be supported either from interior or exterior, and if desired controlled through appropriate arrangements (not shown) to achieve their proper positioning and movement in relation to its axis whereby control over turning of spools of tape-like warps Wa and Wb is suitably and properly enabled by available conventional ways.

To release measured tape-like warps from their spools for the shedding operation in the first half of the weaving cycle, in reference to FIG. 2*a*, the displaceable contact surface of rolling member 1 of unit A1 is moved upward to an intermediate position Y from its base position X and returned back to base position X. This surface displacement of the rolling member 1 draws out certain length of tape-like warps from turnable spools 11*a* corresponding to the length of warp required for enabling shed formation. The displacement distance X to Y of the surface of the rolling member of unit A1 (and also that of unit A2 when it is moved) is a constant measure for a given design of the weaving machine to release warp for forming the shed. For certain types of tapes, such as the tacky, it can be beneficial if the rolling member 1 of A1 (or A2) is also turned clockwise, in reference to the view of arrangement shown in FIG. 2, by a desired degree to gently assist in lightly releasing and paying forward the warp tapes from the spools.

Once the shedding device 12 has formed the shed, the displaceable contact surfaces of rolling members 1 of both units A1 and A2 are moved to their respective final positions Z, as shown in FIG. 2*b*, to release measured tape-like warps from their respective spools for fabric take-up. The total displacement of the surface of rolling member 1 from position X to Z is set to correspond preferably with the width of the tape-like weft 15 that is used in weaving. The displacement Y to Z for both units A1 and A2 is set in a way that displacement X to Z of the unit that is not activated to release warp length for shedding equals displacements X to Y plus Y to Z of the other unit that is activated to release warp length for shedding. This way the warp length released for shedding is taken into account alternately by the two units and release of excess warp length for take-up is prevented. Accordingly, release of equal lengths of warp tapes by units A1 and A2 is always assured for fabric take-up.

As the rotor turns for enabling shed closing, the take-up system is activated to advance the produced fabric from the fabric-fell position 13, indicated in FIG. 2, while simultaneously displaceable surfaces of both rolling members of units A1 and A2 are retracted to their respective base positions X from final positions Z to make available equal measure of warp lengths from both rows for taking-up of the woven material. If necessary, at this moment it can be beneficial if rolling member of A1 (or A2) can be turned anti-clockwise, in reference to the view of arrangement shown in FIG. 2, by a required degree to gently assist in stroking back the warp tapes of the closing shed until the operation of taking-up fabric is satisfactorily completed.

In the second half of the weaving cycle, the same steps as described in the foregoing are performed with the only difference that this time the displaceable contact surface of rolling member 1 of unit A2 is first moved from position X to Y and reverted back to base position X to release measured warp for forming the next shed. The described sequences of operations are repeated alternately to achieve continuity in weaving.

It can be pointed out again that the distance between X and Y positions is a constant for a given machine design. The distance between X and Z positions is variable and depends on the width of the weft tape to be processed in weaving. Through the described working the fabric-fell position 13 indicated in FIG. 2 is always correctly and constantly maintained for different widths of weft tapes for weaving process to progress satisfactorily.

It would be obvious to those skilled in the art that the above-described steps for measured displacement of tape-like warps for shedding and taking-up operations could be combined into one step if the length of the warp to be released for shedding and taking-up of woven material are equal. Thus, in such a situation the contact surfaces of rolling members 1 of units A1 and A2 would be required to be displaced only between positions X and Y.

It would be also obvious to those skilled in the art that the described warp controlling unit could be as well used to accumulate relatively longer lengths of tape-like warps for performing more than one shedding and taking-up operations. For example, by relatively increasing the distance between the base positions X and final positions Z of rolling members 1 of units A1 and A2, longer length of the warps could be released from the spools. By suitable stepwise retraction of the contact surfaces of rolling members 1 of units A1 and A2, and if necessary turning members 1 about corresponding axis in the directions concerned, the measured warp lengths required for shedding and taking-up operations could be supplied in suitable incremental steps.

Figure 3A:
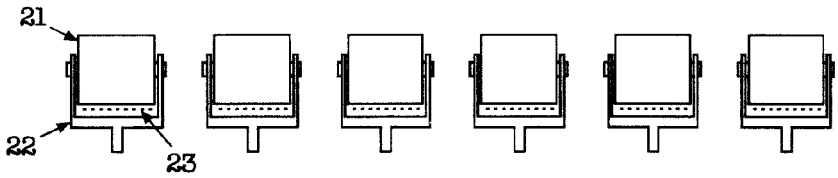
FIG. 3 exemplifies an arrangement for displacing individual tape-like warps.
Figure 3B:
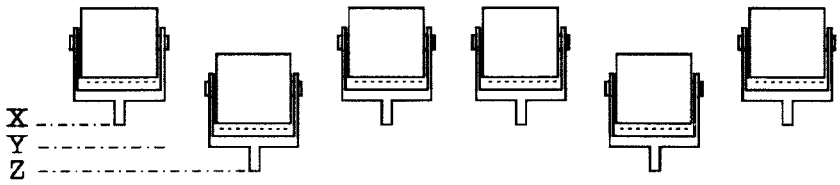
Figure 4:
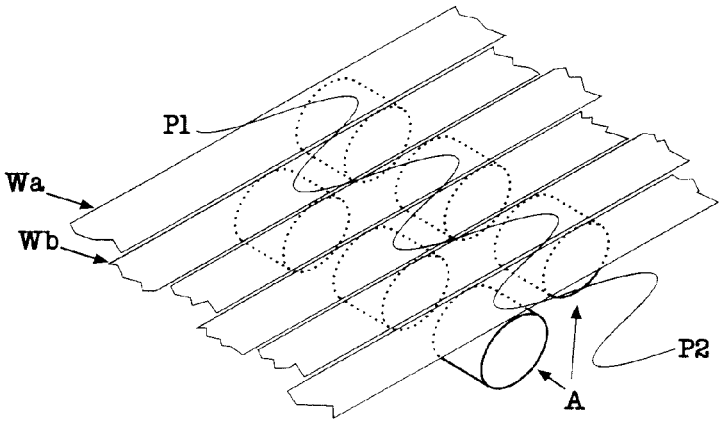
FIG. 4 exemplifies a planar zigzag disposition arrangement for displacing individual tape-like warps in one plane.

While the above described arrangement is suitable for displacing a group of tape-like warps simultaneously from the complete set of warps, as when weaving plain weave, in FIG. 3*a* is shown a construction of the warp displacing unit that comprises rolling member 21 to provide contact surface which is suitable for controlling displacement of individual warp tapes. The rolling member 21 sits in a bracket 22 that is mounted on a suitable arrangement (not shown) for moving each of the units individually between respective base, intermediate and final positions X, Y and Z indicated in FIG. 3*b* just as described above. These positions are shown in reverse order relative to that in FIG. 2 to only highlight that the rolling member 21 is located above the tape-like warp 23 shown in FIG. 3. Further, member 21 can be turned about its axis by required degrees in clockwise (or anti-clockwise) direction for gently assisting in controlling warp tapes and satisfactorily accomplishing fabric take-up as described earlier. The required number of such units can be arranged side-by-side at suitable distance relative to each other, and in two or more rows, to individually displace the tape-like warps 23 as described in the foregoing. FIG. 3*b* shows contact surfaces of two random units positioned at different displacement levels relative to the rest for indication of individual displacement of the tape-like warps. These individual contact surfaces of displacing units shown in FIG. 3 could be also arranged in a suitable planar zigzag arrangement, such as indicated by line P1P2, to control a single planar sheet of warp tapes as shown in FIG. 4.

A person skilled in the art would readily understand now that the described warp controlling devices, whether used for grouped or individual tape-like warps, follow a common method in that its contact surfaces displace to release a measured length of warp required for shedding and taking-up and also retracts for enabling shed closing and measured taking-up notwithstanding whether the measurement of warp released for shed opening is greater than or equal to or lesser than the width of the inserted tape-like weft.

It would be apparent now to the person skilled in the art that the described method could be also employed in tandem or one behind the other, if required. The warp controlling device A could be as well mounted in either horizontal or vertical or angular orientations depending on the warp path configuration employed on the weaving machine. Depending on the type of tape-like warp material required to be processed, the rolling member 1, though preferable in either cylindrical or said barrel forms, could be as well substituted by a bar having suitable cross-sectional shape or a plate of suitable thickness and cross-sectional shape. Further, the displaceable surface of rolling member 1 could be either perforated or embossed or knurled or with projected surface or heat-able or allowing fluid to pass through for functional reasons. In an alternative construction, either a broad belt (to control a group of warp tapes) or multiple narrow belts (to control individual warp tapes) could be used to provide displaceable contact surfaces using suitable driving arrangements for achieving the same function. Such a construction could be useful in realizing an arrangement wherein either the belt can be continuously cleaned during its working, or the belt can be warmed/cooled to achieve specific processing ability, or the belt can be made to pick up and carry a desired formulation for applying onto the tapes for certain enhancement.

Figure 5:
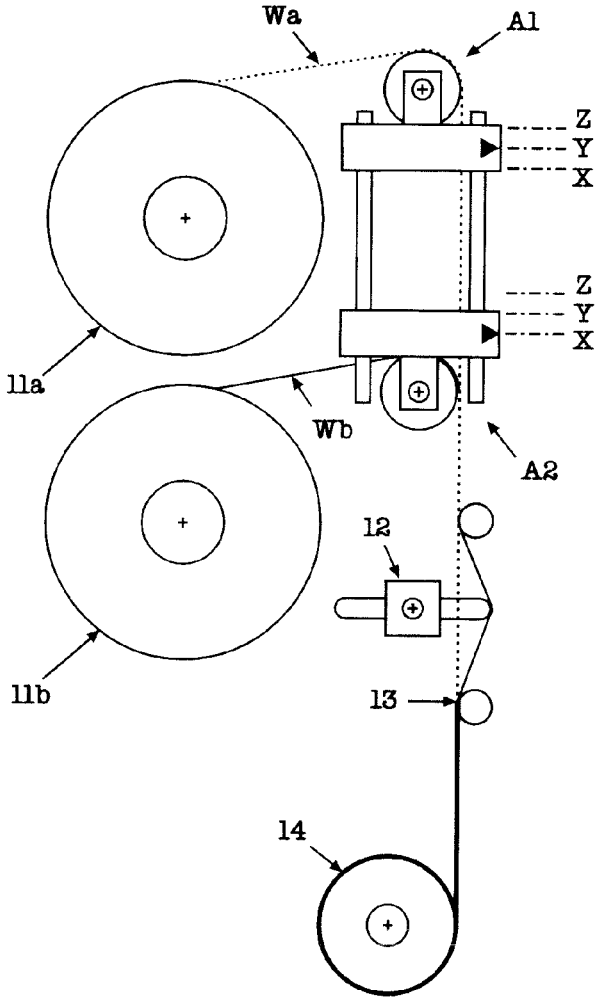
FIG. 5 exemplifies the warp controlling system that additionally functions as a warp guide roller.

It will be obvious now to a skilled practitioner that the described warp controlling device could be also arranged within the weaving set-up in a manner that the displaceable contact surface of rolling member 1 is positioned directly to function as a guide bar as shown in FIG. 5. By making the warp controlling device's displaceable contact surface additionally function as a warp guiding member, there are some advantages: (a) a direct savings of constructional and material costs, (b) increased compactness of the weaving machine for easy and direct accessibility to warp tapes for setting-up or any attention, and (c) substantially reduced warp bending points which correspondingly lowers tension variations in warp, fiber breakage and sticking/adhering of tacky tapes.

A person skilled in the art will understand that although there is no clamping of the tape-like warps performed by the warp controlling device, the option of attaching a suitable clamping arrangement for certain convenience can be considered. For example, having a bar or a roller suitably arranged over the displaceable contact surface of the controlling device.

Figure 6:
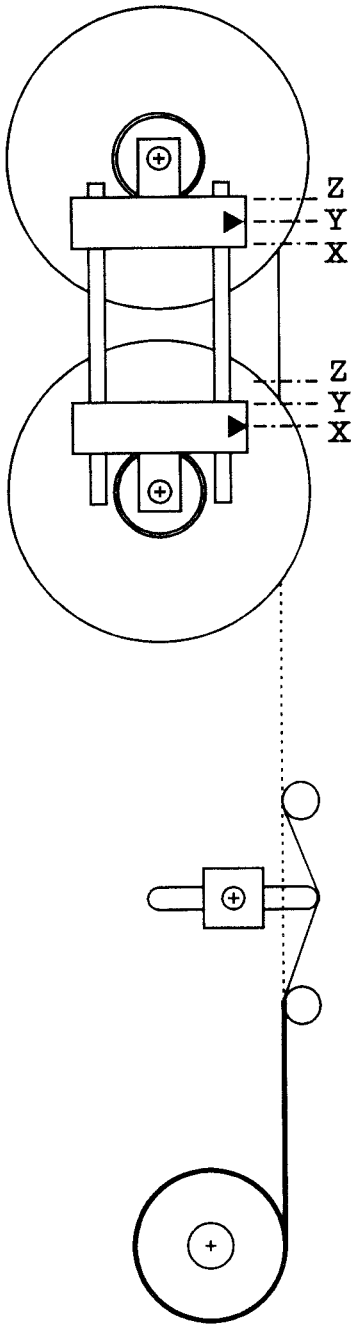
FIG. 6 exemplifies the warp displacement device that additionally directly functions as a warp supply holder or support.

In a further alternative embodiment, the described displacement contact surface of rolling member 1 can be made to directly additionally function as a holder or support for the warp supply spools, as shown in FIG. 6, whereby the spools mounted over it can be reciprocated for measured release of warp and use of guide bars can be eliminated. In such an arrangement, to compensate for reduction in diameter of the warp in the spool, either the rolling member 1 or the entire arrangement can be moved incrementally such that the warp path remains more or less linear as shown in FIG. 6. As will be obvious now to a practitioner of art, this embodiment of invention enables all types of tapes to be directly processed, reduction of production floor-area requirement, and easy and direct access to warp spools.

As can be inferred from the foregoing description, this invention enables gentle measured release of tape-like warps for shedding and taking-up operations without any clamping action to solve the associated problems. Its various details can be altered in many different ways without departing from its spirit. Therefore, the foregoing description is only for illustrating the basic idea of this invention and it does not limit the claims listed below.

The invention claimed is:

1. An apparatus for producing a woven material from tape-like warps and wefts comprising:

a warp supply source for tape-like warps;

a shed forming device to form a shed by said warps;

a weft insertion device for inserting tape-like weft in the shed formed by said warps; and a take-up device for taking-up the produced woven material;

wherein the apparatus further comprises a warp controlling device located in a warp path from the warp supply source to the shed forming device, said warp controlling device comprising at least one displaceable contact surface, being displaceable in a thickness direction of the tape-like warps, and an arrangement to displace the contact surface for displacing at least one of the warps between the warp supply source and the shed forming device without any clamping of the tape-like warps, whereby the displacement of said warp(s) releases them from the warp supply source for shed opening and taking-up, and to retract the contact surface for enabling shed closing and fabric taking up.

2. The apparatus of claim 1, wherein at least one of the displaceable contact surfaces is arranged to continuously remain in contact with the warps.

3. The apparatus of claim 1, wherein the displaceable contact surfaces comprise(s) a low-friction surface.

4. The apparatus of claim 1, wherein the displaceable contact surface(s) comprises a high-friction surface.

5. The apparatus of claim 1, wherein the displaceable contact surface(s) is arranged on a roller.

6. The apparatus of claim 1, wherein the warp controlling device comprises at least two independently operable contact surface displacement units.

7. The apparatus of claim 6, wherein the warp controlling device comprises a first displacement unit having a first displaceable contact surface, and a second displacement unit having a second displaceable contact surface, the first displacement unit being in contact with a first set of warps and the second displacement unit being in contact with a second set of warps, the first and second sets of warps occurring adjacently arranged in relation to each other in the shed.

8. The apparatus of claim 6, wherein the warp controlling device comprises an independently operable displacement unit for each of the warps.

9. The apparatus of claim 1, wherein the displaceable contact surface(s) of the warp controlling device is arranged in or along at least one longitudinal direction of the warp controlling device, said longitudinal direction(s) essentially being parallel to a rotation axis of at least one of a shedding rotor, a take-up roller and a warp spool.

10. The apparatus of claim 1, wherein said device for inserting the tape-like weft includes a gripper for gripping the weft tape in an essentially flat condition by means of clamping, and pulling it through the shed.

11. A method for producing a woven material from tape-like warps and wefts comprising:

providing tape-like warps from a warp supply;

forming a shed by said warps;

inserting tape-like weft in the shed; and taking-up the produced woven material;

displacing at least one contact surface which is being in contact with at least some of the tape-like warps, in a thickness direction of the tape-like warp, for displacing at least some of the warps without any clamping, to release warp from said warp supply for shed formation and taking up; and retracting said displaced contact surface for enabling shed closing and taking-up.

12. The method of claim 11, wherein at least some of the warps are displaced independently of each other.

13. The method of claim 12, wherein a first set of warps are displaced independently of a second set of warps, the first and second sets of warps being arranged adjacently in relation to each other in the shed.

14. The method of claim 12, wherein each warp is displaced independently.

15. The method of claim 11, further comprising the additional step of displacing the contact surface(s), after shed formation but prior to take-up, for release of at least some of the warps from the warp supply for take-up.

* * * * *